US009573793B2

(12) United States Patent
Kalliomäki et al.

(10) Patent No.: US 9,573,793 B2
(45) Date of Patent: Feb. 21, 2017

(54) EXTENDED ROLLER GUIDES

(71) Applicant: KONE Corporation, Helsinki (FI)

(72) Inventors: Jaakko Kalliomäki, Vantaa (FI); Johannes De Jong, Järvenpää (FI)

(73) Assignee: KONE CORPORATION, Helsinki (FI)

( * ) Notice: Subject to any disclaimer, the term of this patent is extended or adjusted under 35 U.S.C. 154(b) by 847 days.

(21) Appl. No.: 13/861,433

(22) Filed: Apr. 12, 2013

(65) Prior Publication Data

US 2013/0220738 A1 Aug. 29, 2013

Related U.S. Application Data

(63) Continuation of application No. PCT/EP2010/065460, filed on Oct. 14, 2010.

(51) Int. Cl.
*B66B 11/02* (2006.01)
*B66B 7/04* (2006.01)

(52) U.S. Cl.
CPC ..... *B66B 11/02* (2013.01); *B66B 11/0206* (2013.01); *B66B 7/042* (2013.01)

(58) Field of Classification Search
CPC ..... B66B 11/0286; B66B 1/42; B66B 11/022
USPC ..... 187/291
See application file for complete search history.

(56) References Cited

U.S. PATENT DOCUMENTS

| | | | | |
|---|---|---|---|---|
| 6,336,522 | B1 * | 1/2002 | Fujita | B66B 1/42 187/293 |
| 7,261,185 | B2 * | 8/2007 | Strebel | B66B 1/40 187/249 |
| 8,069,959 | B2 * | 12/2011 | Oh | B66B 7/042 187/292 |
| 2009/0103227 | A1 * | 4/2009 | Morishita | B60L 13/06 361/144 |

FOREIGN PATENT DOCUMENTS

| | | | | |
|---|---|---|---|---|
| CH | EP 2033925 | A1 * | 3/2009 | B66B 1/42 |
| FI | WO 2012048748 | A1 * | 4/2012 | B66B 11/0206 |
| JP | 3-264483 | A | 11/1991 | |
| JP | 07215634 | A * | 8/1995 | B66B 11/0286 |
| JP | WO 2004046007 | A1 * | 6/2004 | B66B 1/42 |
| JP | WO 2009025042 | A1 * | 2/2009 | B66B 11/0273 |
| WO | WO 2009110907 | A1 * | 9/2009 | B66B 1/42 |

OTHER PUBLICATIONS

WIPO, Machine Translation, WO 2004/0467007 A1, Mar. 4, 2016, pp. 1-3.*

* cited by examiner

*Primary Examiner* — William A Rivera
*Assistant Examiner* — Stefan Kruer
(74) *Attorney, Agent, or Firm* — Birch, Stewart, Kolasch & Birch, LLP

(57) ABSTRACT

The invention relates to an elevator having a car and guide rails along which the car is guided along a hoistway between landings of the elevator, the car comprising: a frame, upper and lower guide elements, which are mounted to said frame at a vertical distance from each other, and exactly one (Continued)

Figure 1:
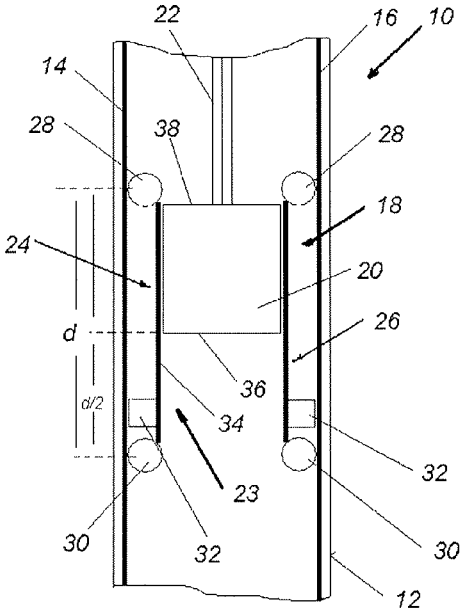

elevator cabin with a cabin floor, in which elevator the cabin is—in travel direction of the car—movably connected to the frame between an uppermost and a lowermost position. By this means a high travel comfort can be obtained with economic space usage at the top and bottom of the hoistway.

19 Claims, 2 Drawing Sheets

EXTENDED ROLLER GUIDES

CROSS REFERENCE TO RELATED APPLICATIONS

This application is a Continuation of PCT International Application No. PCT/EP2010/065460 filed on Oct. 14, 2010, which is hereby expressly incorporated by reference into the present application.

The present invention relates to elevators, particularly elevators running with a speed of more than 3 m/s.

Particularly for a fast running and high rise elevator the travel comfort is an essential issue. On this behalf the elevator car has in current elevator solutions a longer car frame, i.e. car frame which is in travel direction essentially longer than the height of the cabin. As this long car frame enables the guide elements to be placed in a fairly long distance the ride comfort of such an elevator is good and allows large travel velocities.

The disadvantage of this solution is the fact that the elongated car frame needs a lot of additional shaft space at the top and/or the bottom of the elevator shaft which is usually the hoistway of such type of elevators.

The Japanese patent publication 3-264483 discloses a solution wherein guide rollers are mounted to the end of a hydraulically movable support beam which can be controlled to drive into an elongated state as well as into a retracted position. This solution meets on one hand the demand of a high ride comfort. However, this solution is on one hand complicated as it necessitates four hydraulic controlled supports for carrying the guide rollers and on the other hand is still not satisfactory particularly in case of very high velocities.

The object of the invention is to provide an elevator having a high travel comfort without necessitating much space at the top or bottom end of the elevator hoistway and which is easy to implement.

In the specification following terms are used as a synonym: car and elevator car, frame and car frame, guide element and guide roller, cabin and elevator cabin, hoistway and elevator shaft. Various components are mentioned in the claims and in the specification as single components. It shall be understood that these components—except the obligation that per elevator car only one elevator cabin is provided—can be provided in a plurality, as e.g. drives, guides, cars, frame parts etc.

It shall further be understood that the elevator of the invention may comprise all usual elevator components as drive machines, brakes, hoisting ropes, an elevator control, frequency converter as motor drive, hoisting ropes, landing doors etc. The invention is particularly adapted for traction sheave drive systems although not being delimited thereto.

The elevator of the invention has a car and guide rails by which the car is guided along a hoistway, usually an elevator shaft, between landings of the elevator/building.

The elevator car comprises a frame, upper and lower guide elements which are mounted on said frame at a vertical distance from each other and exactly one elevator cabin with a cabin floor. The length of the car frame or the distance between the upper and lower guide elements is essentially larger than the height of the cabin to enable a high travel comfort with the elevator. Of course, generally the upper and lower guide elements are mounted in the vicinity of the upper and lower frame end, respectively. This leads to a long distance between the upper and lower guide elements when a long frame is used and accordingly to a high travel comfort. For fast moving elevators which are the target group of the present invention the guide elements are preferably guide rollers.

According to the invention the cabin is—in travel direction of the car—movably connected to said frame between an uppermost and lowermost position. With this solution the long distance between the upper and lower guide elements is always kept constant even if the elevator approaches the uppermost or lowermost landing. This is an essential advantage over solutions wherein the distance between the upper and lower guide elements could be reduced when the uppermost or lowermost landings are approached. In the invention only the mutual position of the cabin and the frame is changed between the uppermost and lowermost floor.

The invention enables the vertical level of the cabin roof being in proximity with the vertical level of the upper guide elements when the cabin is at the uppermost landing. In this car position also the cabin is in its uppermost position with respect to the car frame.

This proximity means within a fair tolerance, e.g. half a meter, preferably less than 30 cm. Because of this proximity between the upper guide elements and the cabin roof no extended head room has to be provided in the shaft for the upper guide elements mounted to the long frame of the elevator car.

Accordingly, when the elevator car approaches the lowermost landing the cabin is adjusted to assume its lowermost position with respect to the frame so that the vertical level of the cabin floor is in proximity with the vertical level of the lower guide elements. Also here the proximity is evaluated as mentioned above. Therefore no deep shaft pit has to be provided for the long car frame at the lower end of the hoistway.

Accordingly, the present invention ensures a high ride comfort based on the fact that the frame or the distance between the upper and lower guide elements is essentially longer than the cabin height.

The invention refers to cars having exactly one cabin. The invention does not relate to double deck elevators wherein at least one of the two cabins has to be movable with respect to the other cabin or the common frame to meet different distances between landings in the building.

A particularly good ride comfort can be obtained when the length of the car frame or the distance between the upper and lower guide elements is between 150% and 300% of the cabin height.

The movable connection between the cabin and the car frame can be realized with a simple sliding connection based on a sliding guide whereby the uppermost and lowermost position of the cabin with respect to car frame is preferably limited by stops. Preferably these stops are damped so that no additional noise is created when the cabin reaches its uppermost or lowermost position with respect to the frame which is again beneficial for the ride comfort.

The movement between the car frame and the cabin can be realized in a very easy way by the aid of gravity which is either acting on the car frame if the cabin is suspended by the hoisting ropes or which is acting on the cabin if the car frame is suspended by the hoisting ropes. This simple embodiment wherein the adjustment of the mutual positions of the cabin and frame is effected via gravity does not necessitate a separate drive for the relative movement of the components but only need stoppers at the lowermost end of the hoistway, i.e. the shaft pit. These stoppers are coacting with the component not suspended by the hoisting ropes, i.e. the car frame or the cabin. This very simple "drive-less" solution of the invention already provides all advantages of the invention without compromising the shaft space requirement at the shaft top or at the shaft pit and without needing a drive for the relative movement of cabin and frame.

Of course, drive means can be provided to effect the mutual movement or adjustment of the cabin and the car frame as e.g. rack and pinion drives, hydraulic drives, pneumatic drives, linear drives, electric or electromagnetic drives. Basically, the provision of one single drive is enough to effect the relative movement and/or adjustment of cabin and car frame. These drives may act as an adjustment means which is not only able to effect the relative movement of cabin and car frame but also to adjust and lock any desired mutual position of cabin and car frame.

Preferably the car is suspended in the hoistway by means of hoisting ropes and said hoisting ropes are connected only to the cabin. In this case only the mutual position of the frame has to be changed with respect to the cabin. Thus, any adjustment means must only move or lock the weight of the car frame and not that of the cabin (with load).

Preferably in this case the adjustment between the uppermost and lowermost position of the cabin with respect to the frame is effected by gravity acting on the frame which obviates the need of any moving means for the frame. Preferably, in this case at least one stopper is provided in the pit of the hoistway which coacts with the frame or any part connected therewith, e.g. the lower guide elements. By that means relative movement between cabin and frame, which is only necessary at the lower shaft end, is effected by stopping the vertical movement of the frame while the cabin is still moved by the hoisting ropes.

The advantage of this solution is that in all positions of the car in the hoistway except at the lowermost landing, the mutual position of the cabin and the frame is adjusted by gravity such that the cabin is in its uppermost position, and that in this position the cabin floor is centralized between the upper and lower guide elements. This enables a maximum of ride comfort nearly over the complete shaft length.

Of course, if for example gravity is used for effecting the relative movement between the cabin and car frame, the adjustment means may be provided only as locking means which interlock a desired or the actual mutual position of cabin and car frame.

All these solutions provide an easy way to effect the relative movement of cabin and car frame.

One central aspect of the invention—which also might be regarded as a separate invention—is the centralization of the cabin floor between the upper and lower guide elements. Preferably the elevator is configured to centralize a position of a pre-defined level of the cabin, preferably the cabin floor, with respect to the upper and lower guide elements as long as the car is not located at the uppermost or lowermost landing of the elevator. By this means the elevator ride comfort is improved. Any vibrations, jerks or other unintended movements of the cabin during its travel along the hoistway are transmitted via the cabin floor to the passengers. Accordingly, the invention deems a prior aim to keep theses movements from the cabin floor which can best be realized by arranging it centrally between the upper and lower guide elements. Therefore, the location of the cabin floor in a centralized position, i.e. in the middle between the upper and lower guide elements, ensures the most smooth and unaffected ride in the elevator cabin even with very fast velocities. By the invention any horizontal jumps or vibrations caused by corresponding horizontal deviations of the guide rails or of its guide tracks from an exact vertical line acting on the cabin floor are minimized, while the distances of the cabin floor to the upper as well as the lower guide elements are large. Therefore the elevator ride is mostly unaffected by little failures of the guide rails or by any dirt sticking to the guide rails or the guide rollers.

Of course the centralization of the car floor to the middle between the upper and lower guide elements does not mean that this position has to be achieved exactly but deviations from the exact central position of e.g. +/−0.5 m are allowed without affecting this improvement of the elevator ride comfort essentially.

In a preferred embodiment of an invention the guide rail brake is fixed to said frame as the rigidity and strength of the frame is better adapted to carry up any loads or impacts in connection with guide rail braking or gripping actions than the cabin.

Preferably, the elevator is configured to lock the mutual position between the cabin and the car frame if the guide rail brake or the gripping device is activated and/or if a safety circuit of the elevator is opened. By this measure it can be ensured that the forces and braking ramps of the car are not affected by the circumstance that the cabin is movable with respect to the frame. By the locking of the mutual position of cabin and frame which is affected in any case of guide rail braking or emergency action it is therefore ensured that the technical requirements set by elevator rules are met. Therefore the invention's main target of an improved elevator ride comfort without necessitating a large head space or shaft pit does not affect the security of the complete elevator system.

Another aspect of the invention according to claim 14 relates to an elevator having an elevator car and guide rails for guiding the car in a hoistway of the elevator between landings. The car has upper and lower guide elements and the cabin has a cabin floor, which cabin floor is movable relative to the lower and/or upper guide elements. According to this aspect of the invention the position of the cabin floor is adjustable to be centralized between the upper and lower guide elements as long as the elevator car is away from the lowermost or uppermost landing of the elevator/building. In the same way the distance between the cabin floor and the corresponding upper or lower guide element is adjustable to be reduced with respect to said centralized position when the car approaches the uppermost or lowermost landing. By this measure it is achieved that the cabin floor always takes up the centralized position except when the car approaches either the top most or the lowermost landing, in which case the distance between the cabin floor and the corresponding upper or lower guide element will be reduced to allow the cabin be moved into the uppermost possible position in the elevator shaft head or into the lowermost position in the shaft pit. Therefore this solution of the invention maximizes the elevator ride comfort which is essentially relevant particularly for high rise elevators and for very fast elevators with a velocity of more than 3 m/s as well as makes efficient use of the upper and lower shaft space. At the uppermost or lowermost landing the mutual position of the cabin and the car frame can be adjusted such that at the uppermost floor the cabin takes up its uppermost position with respect to the frame wherein the cabin roof is essentially on the same vertical level as the upper guide elements whereas in the lowermost landing the cabin is moved to its lowermost position with respect to the car frame so that the cabin floor is essentially on the same level as the lower guide elements which allows the optimal use of the lower hoistway. Therefore no additional room has to be provided for the lower guide elements in the pit of the elevator shaft (lower hoistway end). The common levels need not exactly be met but may vary with a play of +/−0.5 m, preferably +/−0.3 m.

In a preferred embodiment of the invention the car floor is centralized with respect to upper and lower guide elements when the cabin assumes its uppermost position with respect to the frame. In this embodiment the cabin may rest immovable in the complete travel path. Only when the lowermost landing is approached the cabin has to be moved to its lowermost position with respect to the car frame as to bring the cabin floor to the proximity of the lower guide elements. This reduces the necessity of having deep shaft pit. This advantageous solution can be easily implemented when only the cabin is connected with the hosting ropes. When approaching the lowermost landing the mutual movement of cabin and frame could be achieved by letting the frame run on stoppers or buffers positioned in the shaft pit whereas cabin is further lowered by the hoisting ropes to its lowermost position with respect to the car frame, in which lowermost position the cabin floor is in alignment with the lowermost landing.

Instead of letting the cabin or car frame run on buffers the velocity difference between both components to effect their mutual movement by gravity can also be realized at the shaft end by taking the braking force from the guide rails, e.g. by braking the rotation of the guide rollers. thus the car frame is decelerated faster by the braking action on the guide rollers than the deceleration of the cabin suspended at the hoisting ropes effected by deceleration of the velocity of the drive machine. Thus, the movement of the cabin to its lowermost position with respect to the car frame is obtained smoothly.

Preferably said upper and lower guide elements are mounted to said frame at a substantially constant distance from each other to provide a uniform load distribution in the frame.

The invention further provides a method which is based on an elevator having a car and guide rails for guiding the car along a hoistway between landings. The car has a cabin with a cabin floor and the car further has upper and lower guide elements which co act with the guide rails. According to the method of the invention the position of the cabin floor with respect to the upper and lower guide elements is adjusted to be centrally between the upper and lower guide elements when the car is away from the lowermost or uppermost landing of the elevator. By this method step the centralization of the cabin floor in the middle between the upper and lower guide elements effects the highest ride comfort with respect to possible horizontal deviations in the guide path of the guide rails. By reducing the distance of the cabin floor with respect to the upper and/or lower guide elements (with respect to the distance corresponding to the above mentioned centralized cabin floor position) when the corresponding uppermost or lowermost landings are approached the car utilizes the top and bottom end of the hoistway effectively. Thus, it is possible that the lower guide elements do not extend essentially below the cabin floor at the lowermost landing. In the same way the upper guide elements do not extend essentially above the cabin roof at the uppermost landing.

Accordingly, this method enables the highest possible ride comfort based on the centralization of the car floor along the uppermost part of the hoistway. Thus, only when the car approaches the lower end of the hoistway (the lowermost landing), generally within the last one to three meters of the elevator shaft this central position of the car floor is given up when the car is lowered to the lowermost position with respect to the car frame.

Of course, the safety gear can be mounted to other locations of the elevator car than the car frame, etc. to parts of the cabin.

For the movable suspension of the cabin with respect to the car frame the cabin may have its own frame which stabilizes the movable connection to the car frame.

Of course, it is not necessary in the invention that during the travel the cabin is in the uppermost position wherein the cabin roof is in the vicinity of the upper guide rollers. Further, it is not necessary that the cabin is in the uppermost position wherein the cabin roof is in the vicinity of the upper guide rollers when the cabin floor is centralized.

The invention is now described with the aid of the corresponding schematic drawings.

Figure 2:
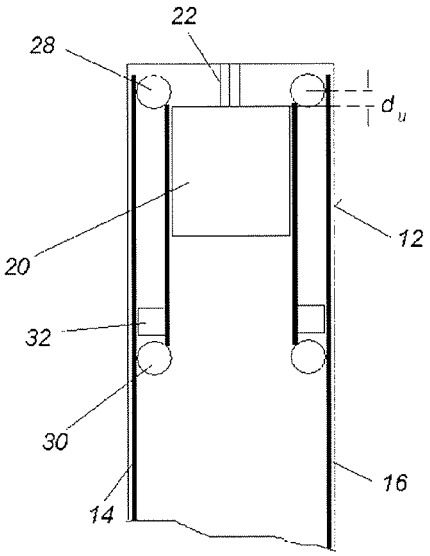
Figure 3:
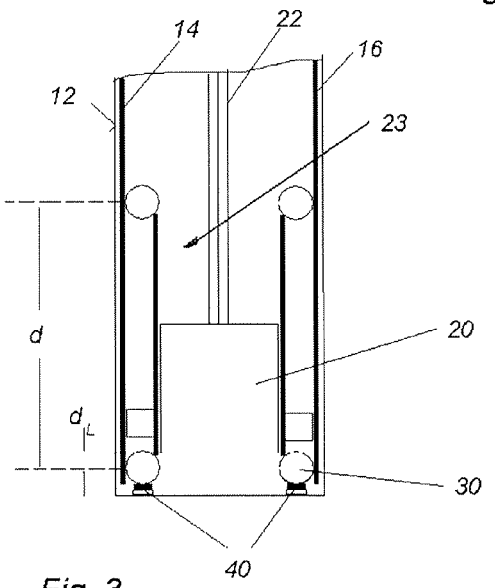
Figure 4:
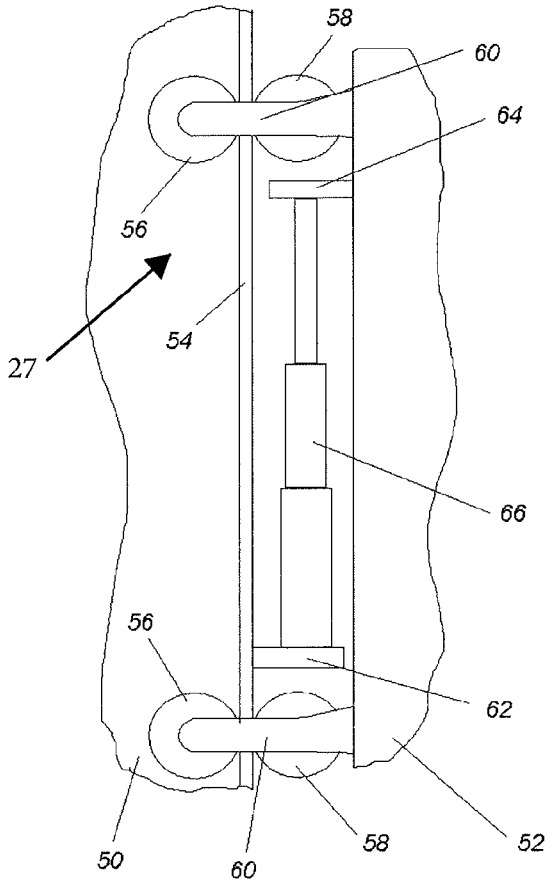
Figure 5:
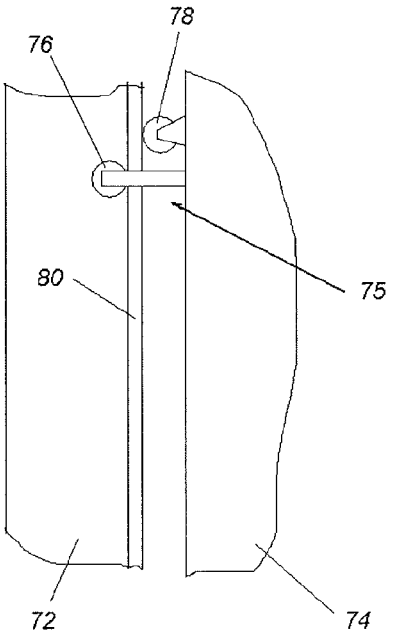

FIG. 1 is a side view of an elevator with a car somewhere in the middle of an elevator shaft, FIG. 2 shows the same elevator of FIG. 1 with the car at the top of the elevator shaft, FIG. 3 shows the elevator of FIG. 1 with the car of the bottom of the elevator shaft, FIG. 4 shows an adjustment means for the adjustment of the mutual position of the car frame and FIG. 5 shows another embodiment of an adjustment means with two sprocket wheels meshing a rack on two opposite sides.

The elevator 10 in FIG. 1 has an elevator shaft 12 wherein guide rails 14, 16 are extending vertically along the length of the elevator shaft. The elevator comprises an elevator car 18 having a cabin 20 suspended by hoisting ropes 22 and two identical frame parts 24, 26 on both sides of the cabin 20. Of course the elevator can also be implemented only with one frame part. Both frame parts may be located on opposite sides of the elevator car.

The frame parts 24 and 26 form the frame 23 of the car 18 and may be connected by connecting structures (not shown), if desired. Upper guide rollers 28 and lower guide rollers 30 are mounted to the frame parts 24, 26 of the frame 23 which interact with the guide rails 14, 16 as to guide the car 18 in the elevator shaft 12. The upper and lower guide rollers 28, 30 are preferably mounted in the region of the upper and lower ends of the frame parts 24, 26 so as to efficiently use the frame length for the maximum distance between the upper and lower guide rollers meeting the guide rails. Further, a safety gear 32 is connected to both frame parts 24, 26 to effect any braking in connection with the guide rails 14, 16. The cabin 20 is movably connected to the longitudinal vertically extending support profiles 34 of the frame parts 24, 26 via a linear bearing 27. On this behalf the support profiles comprise a guiding track which interacts with corresponding guide parts, e.g. rollers, of the cabin to form the linear bearing 27.

In FIG. 1 the movement of the frame parts 24, 26 with respect to the cabin is effected via gravity acting on the frame parts 24, 26. Accordingly, the frame parts 24, 26 are pulled down by their own weight with respect to the cabin 20 which is supported by the hoisting ropes 22. Thus, the cabin 20 is located in its uppermost position with respect to the frame 23 during the travel along the length of the shaft except the lowermost landing. FIG. 1 shows the arrangement somewhere in the middle of the shaft. In its uppermost position the cabin floor 36 is centralized in the middle between the upper guide rollers 28 and the lower guide rollers 30. As the distance between the upper/lower guide rollers is d, the distance of the cabin floor 36 from the upper as well from the lower guide elements is about d/2. Of course, the position of the cabin floor must only roughly be centralized, which means that a play of +/−0.5 m does not affect the essential advantage of improved ride comfort. Accordingly this situation and arrangement of the cabin 20 with respect to the car frame 23 guaranties optimum ride comfort of the elevator.

FIG. 2 shows the elevator 10 of FIG. 1 with the car 18 at its uppermost position in the top of the elevator shaft 12. In this position the level of the cabin roof 38 deviates from the level of the upper guide rollers only by a play $d_u$ which is less than +/−0.5 m, preferably less than +/−0.3 m. By this means the long frame 23 of the car 18 does not necessitate any additional shaft space in the top of the elevator shaft although the length of the frame including the guide rollers is about the double of the height of the cabin.

FIG. 3 shows the elevator 10 when the car 18 approaches the shaft bottom. In this case the lower rollers 30 mounted to the frame 23 run on stoppers 40 so that the vertical downwards movement of the frame 23 is stopped by the lower guide rollers 30 meeting the stoppers 40 while the cabin still moves down suspended by the hoisting ropes 22. The further downward movement of the cabin is stopped at the lowermost landing of the elevator preferably when also the cabin has achieved its lowermost position with respect to the car frame 23. Accordingly, no extended pit has to be provided for the elongated frame 23 of the elevator car 18. The level of the cabin floor deviates in this situation from the level of the lower guide rollers 30 by the play $d_L$ which is preferably less than +/−0.5 m, preferably less than +/−0.3 m.

Accordingly, this embodiment realizes with very little effort an extraordinary ride comfort particularly for high rise or very fast elevators and provides on the other hand a maximum space efficiency with respect to the upper and lower end of the elevator shaft.

A locking device (not shown) may be provided to lock the mutual position between cabin and car frame particularly in braking and/or emergency situations to stop a further down travel of the cabin if the gripping devices 32 of the frame 23 are activated. Thus, this construction corresponds with current safety regulations.

Of course, in the embodiment of FIGS. 1 to 3 it is not necessary in the invention that during the travel the cabin is in the uppermost position wherein the cabin roof is in the vicinity of the upper guide rollers. Further, it is not necessary that the cabin is in the uppermost position wherein the cabin roof is in the vicinity of the upper guide rollers when the cabin floor is centralized.

FIG. 4 shows a possible adjustment means for adjusting the mutual position of a car frame 50 and a cabin 52. The frame 50 comprises a vertical leg on its edge having an L or T shaped profile so as to build a guide track 54 which is gripped on both opposite sites by support rollers 56, 58 which are fixed with a support beam 60 to the cabin 55. The cabin 55 has at least two of such horizontally extending roller arrangements 56, 58, preferably one in the proximity of the car roof and one in the proximity of the car floor. The frame comprises a frame support plate 62 and the cabin comprises a cabin support plate 64. Between the frame support plate 62 and the cabin support plate 64 a hydraulic operated piston arrangement 66 is provided. This arrangement enables the movement and adjustment of the relative positions of frame 50 and cabin 52. This device also locks the actual mutual position in case of emergencies.

FIG. 5 shows another embodiment of an adjustment means for a movable connection between a car frame 72 and a cabin 74. In this solution the cabin 74 has extending from its upper side wall to the frame 72 a drive and guide arrangement 75 formed by two pinions 76, 78 extending from the cabin in the direction of the car frame 72. These pinions 76, 78 mesh a vertically extending rack 80 of the car frame 72. The pinions 76 and 78 are driven by electro motors (not shown) so that this arrangement provides for the drive as well as for the guide and support of the cabin 74 with respect to the car frame 72. This arrangement 75 locks the mutual position of cabin and frame if the electro motors are not operated (e.g. in emergencies).

In the embodiment of FIG. 5 either stops can be provided to limit the movement of the cabin 74 with respect to the car frame 72 or the uppermost or lowermost mutual positions can be defined via the control of the pinions 76, 78. Of course the drive and guide arrangement 75 shown in FIG. 5 is located at least two vertically different positions of the cabin.

In the embodiments of FIGS. 4 and 5 the movement of the cabin with respect to the car frame is not effected by gravity in contrast to the embodiment of FIGS. 1 to 3.

The invention is not restricted to the embodiments as mentioned above but can be varied in the scope of the protection as defined in the claims.

The invention claimed is:

1. An elevator having a car and guide rails along which the car is guided along a hoistway between landings of the elevator, the car comprising:

a frame, upper and lower guide elements, which are mounted to said frame at a vertical distance from each other, and exactly one elevator cabin with a cabin floor, in which elevator the cabin is—in a travel direction of the car—movably connected to the frame between an uppermost and a lowermost position, wherein a position of the cabin floor is configured to be centralized with respect to the upper and lower guide elements as long as the car is not located at an uppermost or a lowermost landing of the elevator.

2. The elevator according to claim 1, wherein the car has adjustment means configured to move or lock the cabin relative to the frame.

3. The elevator according to claim 2, wherein the elevator comprises a control of the elevator, and wherein the adjustment means is controlled by the control to selectively move or lock the cabin relative to frame dependent on the position of the car in the hoistway.

4. The elevator according to claim 1, wherein the car is suspended in the hoistway by means of hoisting ropes.

5. The elevator according to claim 4, wherein an adjustment between the uppermost and lowermost position of the cabin with respect to the frame is effected by gravity acting on the frame.

6. The elevator according to claim 4, wherein in a pit of the hoistway a stopper is provided for the frame or any part connected therewith.

7. The elevator according to claim 1, wherein the elevator is configured to adjust a position of the cabin with respect to the frame to the uppermost position when the car is reaching the uppermost landing of the elevator.

8. The elevator according to claim 1, wherein the elevator is configured to adjust a position of the cabin with respect to the frame to the lowermost position when the car is reaching the lowermost landing of the elevator.

9. The elevator according to claim 1, wherein the length of the frame in a direction of the hoistway is 150 to 300% of a height of the cabin.

10. The elevator according to claim 1, wherein in the uppermost position of the cabin with respect to the frame, a vertical level of the cabin roof is in a proximity of the vertical level of the upper guide elements and, wherein in the lowermost position of the cabin with respect to the frame, the vertical level of the cabin floor is in the proximity of the vertical level of the lower guide elements.

11. The elevator according to claim 1, wherein in all positions of the car in the hoistway except at the lowermost landing, a mutual position of the cabin and the frame is adjusted by gravity such that the cabin is in its uppermost position, and that in this position the cabin floor is centralized between the upper and lower guide elements.

12. The elevator according to claim 1, wherein the elevator comprises a guide rail brake fixed to said frame.

13. The elevator according to claim 1, wherein a mutual position between the cabin and the frame is configured to be locked, if a gripping device connected with the frame is activated and/or if a safety circuit of the elevator is opened.

14. The elevator according to claim 1 wherein the upper and lower guide elements are guide rollers.

15. An elevator with landings having an elevator car and guide rails for guiding the car in a hoistway of the elevator between said landings, the car having upper and lower guide elements, and exactly one cabin having a cabin floor, which cabin floor is movable relative to the lower and/or upper guide elements, whereby, when the car is away from the lowermost or uppermost landing of the elevator, the position of the cabin floor is adjustable to be centralized between the upper and lower guide elements, and that, when the car approaches the topmost or lowermost landing, a distance between the cabin floor and a corresponding upper/lower guide element is adjustable to be reduced with respect to said centralized position.

16. An elevator according to claim 15, wherein except the lowermost landing the position of the cabin floor is adjustable to be centralized between upper and lower guide elements and that at the lowermost landing the distance between the cabin floor and the lower guide elements is adjusted to be reduced with respect to the centralized position.

17. The elevator according to claim 15 wherein the elevator car has an adjustment means for moving said cabin floor relative to the lower and/or upper guide elements, said adjustment means further being controllable by a control of the elevator, whereby, when the car is away from the lowermost or uppermost landing of the elevator, the control of the elevator controls the adjustment means so as to position the cabin floor centrally between the upper and lower guide elements.

18. The elevator according to claim 15 wherein the car comprises a car frame to which the upper and lower guide elements are mounted, and wherein the position of the cabin with respect to the car frame is movable in travelling direction of the car.

19. A method for controlling an elevator having a hoistway, a car and guide rails, wherein the car is guided along the guide rails in the hoistway between landings, the car having upper and lower guide elements and exactly one cabin with a cabin floor, in which method a position of the cabin floor with respect to the upper and lower guide elements is adjusted to be central between the upper and lower guide elements when the car is away from a lowermost or an uppermost landing of the elevator, and in which method a distance between the cabin floor and the upper and lower guide elements is adjusted to be reduced when the car is at the uppermost or lowermost landing, respectively.

* * * * *